US006851874B2

(12) United States Patent
Gonzalez et al.

(10) Patent No.: US 6,851,874 B2
(45) Date of Patent: Feb. 8, 2005

(54) METHODS AND SYSTEMS OF PRODUCING BLISTER PACKAGING

(75) Inventors: Jose M. Gonzalez, Aguadilla, PR (US); Enrique C. Abreu, Mayaguez, PR (US); Angel L. Enriquez, Anasco, PR (US); Jorge E. Badillo, Rincon, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 234 days.

(21) Appl. No.: 10/174,263

(22) Filed: Jun. 18, 2002

(65) Prior Publication Data

US 2003/0230209 A1 Dec. 18, 2003

(51) Int. Cl.[7] ..... B41J 11/44

(52) U.S. Cl. ..... 400/61; 400/70; 400/76; 101/227; 101/228

(58) Field of Search ..... 400/61, 70, 76; 101/227, 228

(56) References Cited

U.S. PATENT DOCUMENTS 5,964,151 A 10/1999 Mathea
6,164,200 A 12/2000 Mathea
6,550,905 B1 * 4/2003 Deckers ..... 347/100
6,564,710 B1 * 5/2003 Mathea ..... 101/227
6,592,978 B1 * 7/2003 Miller et al. ..... 428/213
2002/0184051 A1 * 12/2002 Yu et al. ..... 705/2

FOREIGN PATENT DOCUMENTS

EP 0915014 A1 * 5/1999 ..... B41F/7/36

* cited by examiner

*Primary Examiner*—Charles H. Nolan, Jr.

(57) ABSTRACT

A blister packaging production line preferably includes an unmarked supply of backing for blister packaging, a printer for selectively printing on the backing and a host system controlling the printer and providing a variety of desired designs to the printer. The design being printed on the backing can be changed on-demand by transmitting a new design from the host system to the printer. Additionally, a blister packaging production line may include an unmarked supply of material backing for blister packaging, a printer for selectively printing on the material and a shaping device for forming recesses in the material that will receive items being blister packaged. The printed design can be of any desired length.

47 Claims, 4 Drawing Sheets

METHODS AND SYSTEMS OF PRODUCING BLISTER PACKAGING

FIELD OF THE INVENTION

The present invention relates the field of blister packaging. More specifically, the present invention provides methods and systems for selectively printing on either or both of the backing or shaped material of the blister packaging. The present invention can print on-demand designs on any length of packaging material.

BACKGROUND OF THE INVENTION

A blister package is commonly used, for example, in the pharmaceutical industry, to package pills. A sheet of colored or clear plastic, typically polyvinyl chloride (PVC), is shaped to provide a number of recesses into which individual pills are deposited. Then, a layer of paper or foil is sealed to the plastic sheet to secure the pills in the individual "blisters." If foil is used, it is typically an aluminum foil.

When a pill is needed, pressure is applied to the pill to cause it to break through the paper or foil that seals in it place. The pill can then be taken while the remaining supply of pills is securely and sanitarily stored in the remaining blisters of the packaging.

Typically, with blister packaging, the foil or paper used to seal the blisters is pre-printed with advertising, instructions or other material desired by the manufacturer. This printing is specific to the pills or other items being blister-packaged. The pre-printed foil or paper can be supplied in rolls to the facility that will produce the final blister packaging.

If a production line is used to package a variety of different pills or other blister-packaged items, it will typically be necessary to replace the roll of foil or paper each time a new item is to be packaged. This is so that the roll of foil or paper used to seal the packaging for that item has material printed thereon that is specific and relevant to that packaged item.

Unfortunately, time and expense are required to switch the roll being used in the blister package production line. Additionally, storage space is required for the variety of pre-printed rolls of paper or foil that may be used by that particular production line. These factors increase the cost and time required to produce blister-packaged items.

SUMMARY OF THE INVENTION

The present invention provides, among other things, a blister packaging production line that includes an unmarked supply of backing for blister packaging, a printer for selectively printing on the backing and a host system controlling the printer and providing a variety of desired designs to the printer. The design being printed on the backing can be changed by transmitting a new design from the host system to the printer. The new design can be of any desired length.

In another embodiment, the present invention also provides a blister packaging production line that includes an unmarked supply of material backing for blister packaging, a printer for selectively printing on the material and a shaping device for forming recesses in the material that will receive items being blister packaged.

In another embodiment, the present invention provides a blister packaging production line that includes an unmarked supply of backing for blister packaging, a printer for selectively printing on the backing, an unmarked supply of material backing for blister packaging, a printer for selectively printing on the material, a shaping device for forming recesses in the material that will receive items being blister packaged and a blister packaging system for depositing items to be packaged in the recesses of the material and sealing the backing to the material.

In another embodiment, the present invention also provides a method of producing blister packaging by providing an unmarked supply of backing for blister packaging, selectively printing on the backing with a printer, controlling the printer to print a variety of desired designs on the backing and changing a design being printed on the backing by transmitting a new design to the printer from a host system.

In another embodiment, the present invention also provides a method of producing blister packaging by providing an unmarked supply of material for blister packaging, selectively printing on the material and forming recesses in the material that will receive items being blister packaged.

In another embodiment, the present invention also provides a method of producing blister packaged items by providing an unmarked supply of backing for blister packaging, selectively printing on the backing, providing an unmarked supply of material for blister packaging, selectively printing on the material, forming recesses in the material that will receive items being blister packaged, depositing items to be packaged in the recesses of the material and sealing the backing to the material to produce the blister packaged items.

BRIEF DESCRIPTION OF THE DRAWINGS

The accompanying drawings illustrate preferred embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate similar, but not necessarily identical, elements.

DETAILED DESCRIPTION OF THE PREFERRED EMBODIMENTS

Figure 1:
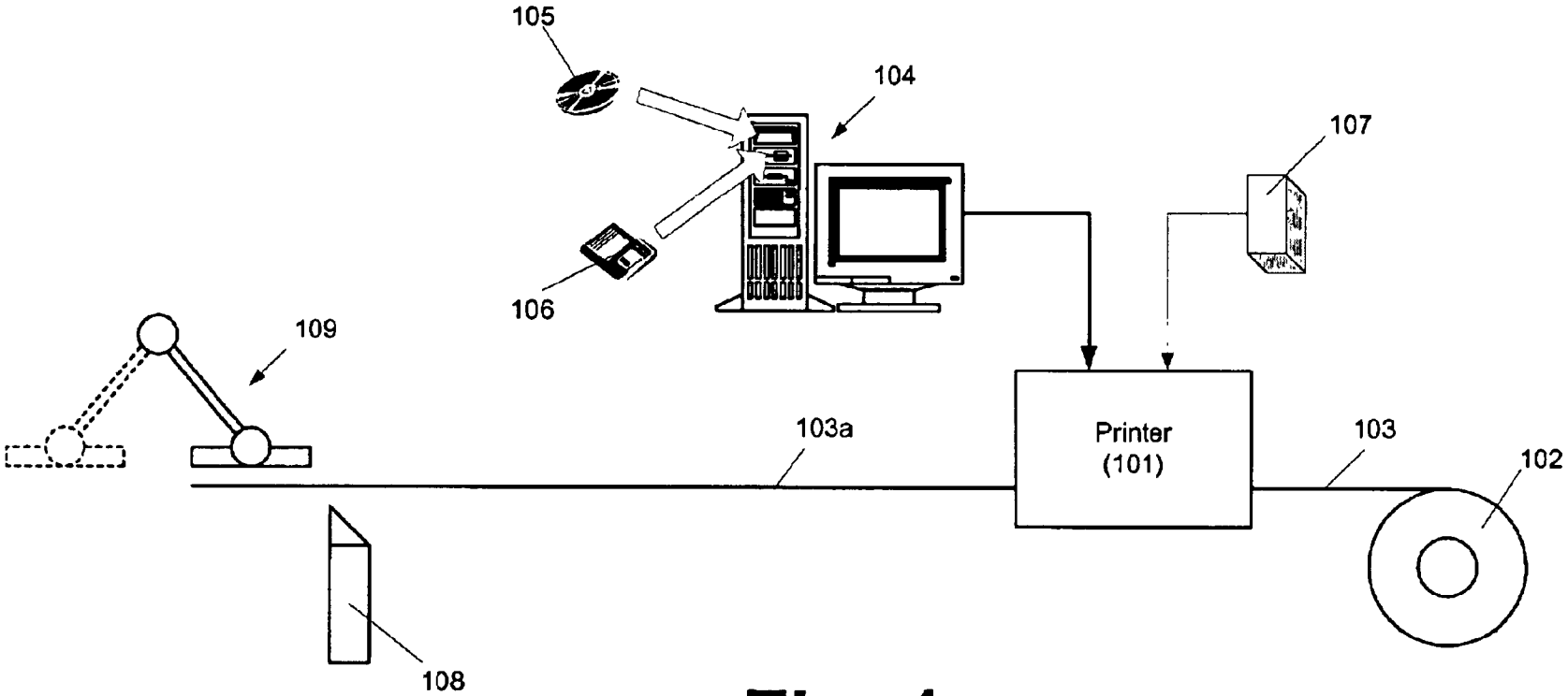
FIG. 1 illustrates one embodiment of the present invention in which a printer is placed in a production line to print a variety of material on a sheet of foil, paper or paper-backed foil for blister packaging. The printer, under control of a host system, selectively prints material that is specific and relevant to items then being packaged. The printed sheet is then cut in sections for further processing. Sections to be cut can be of variable length.

FIG. 1 illustrates one embodiment of the present invention in which a printer is placed in a production line to print a variety of material on backing for blister packaging. The backing may be, for example, a sheet of foil, paper or paper-backed foil. The printer, under control of a host system, selectively prints material on the backing that is specific and relevant to the items then being packaged or for which packaging is being prepared. The printed sheet is then cut in sections for further processing.

As shown in FIG. 1, a blank or unmarked roll (102) of paper, foil or paper-backed foil is provided for custom printing. This roll is suitable for use as backing in blister packaging. If the roll (102) is foil, it is preferably aluminum foil.

The sheet (103) from the roll (102) is fed through a printer (101). The printer (101) is preferably a process color printer so as to provide color printing on the sheet (103). Because color is preferred, the printer (101) may be, for example, a color laser printer or a color inkjet printer. Inkjet printers typically provide a less expensive color printing solution and, therefore, may be preferred. However, any process color printing device could be employed under the principles of the present invention.

The printer (101) may include a toner or ink cartridge (107). This cartridge (107) may contain ink or toner of three or more colors that can be mixed to obtain any other color. For example, a cartridge (107) for the printer (101) may include ink or toner that is cyan (C), yellow (Y), magenta (M) and black (K). Alternatively, the black ink or toner may be housed in a separate cartridge (not shown).

The color printer (101) will consume the ink or toner in the cartridge (107) as it prints desired material on the sheet (103). When the cartridge is empty, or if one of the colors is completely expended, the cartridge (107) can be replaced or refilled.

By placing a printer (101) in the production line, it becomes possible to print any desired pattern, image, text, etc. on the sheet (103). Thus, there is never a need to change the roll (102) when the item being packaged by the production line changes. Rather, it is simply a matter of feeding a new print job, i.e., new image data, to the printer (101) so that the printer (101) can print material on the sheet (103) that is appropriate to the item being packaged.

One preferred method of controlling the printer (101) to print material for a variety of different packaging is to connect the printer (101) to a host system (104). The host system (104) may include a computer with a monitor and user input devices, such as a keyboard and a mouse. The computer (104) may have a printer driver application installed thereon such that the computer (104) can send different print jobs to the printer (101) and thereby control the material printed by the printer (101). It should also be noted that the host system (104) or its functionality may be integrated into the printer (101).

For example, when packaging is to be prepared for a particular item, there will be a desired design (e.g., text, images, patterns, etc.) appropriate for that item that should be printed on the sheet (103). This desired design is provided to host system (104). The desired design can be created on the host system (104) or downloaded to the host system (104) from another device or network to which the host system (104) is connected. Alternatively, the desired design can be created elsewhere and conveyed to the host system (104) on a removable data storage device, such as a floppy disk (106), CD-ROM (105) or remote database. For this purpose, the host system (104) preferably includes a floppy disk drive, and/or a CD-ROM drive or other drive for reading a form of removable data storage media.

Once the desired design, in electronic form, is provided to the host system (104), it can be transmitted to the printer (101). The printer (101) will then format the design data and print the desired design on the sheet (103).

When packaging is to be prepared for a different item, requiring a different design to be printed on the sheet (103), there is no need to waste time replacing the roll (102). Rather, a different and appropriate design is transmitted from the host system (104) to the printer (101). The printer (101) then begins producing a printed sheet (103*a*) that has been printed within the new desired design.

After the sheet (103*a*) has been printed, it can be used in several ways. For example, as shown in FIG. 1, a cutter (108) may segment the sheet (103*a*) for use in individual blister packages. A handling device (109) may be employed to remove individual segments of the printed sheet (103*a*). The sheet segments may be then sent directly on for use in blister packaging or may be stored for later use or shipment.

U.S. Pat. No. 5,964,151 to Mathea for "Apparatus for Accurately Imprinting Continuous Rolls" (which is incorporated herein by reference) teaches a system for controlling and timing the output and segmentation of a printed sheet. This system can be used in an embodiment of the present invention to meter the output of the sheet (103*a*) to the cutter (108) and handling device (109).

Figure 2:
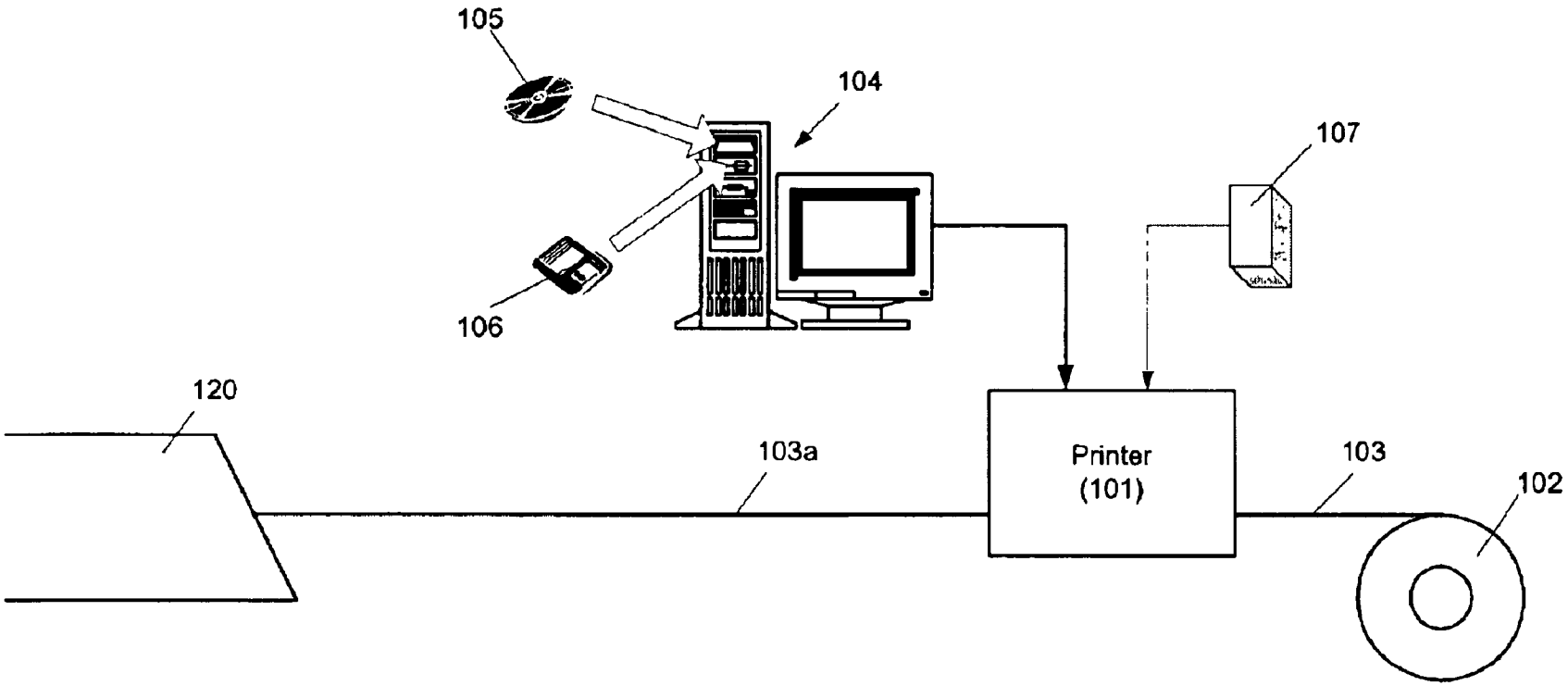
FIG. 2 illustrates another embodiment of the present invention in which a printer is placed in a production line to print a variety of material on a sheet of foil, paper or paper-backed foil for blister packaging. The printer, under control of a host system, selectively prints material that is specific and relevant to items then being packaged. The printed sheet is feed as a continuous sheet into a blister packaging production line.

FIG. 2 illustrates another embodiment of the present invention in which a printer is placed in a production line to print a variety of material on a sheet of foil, paper or paper-backed foil for blister packaging. The printer, under control of a host system, selectively prints material that is specific and relevant to items then being packaged. The printed sheet is feed as a continuous sheet into a blister packaging production line.

As shown in FIG. 2, after the printed sheet (103*a*) is output by the printer (101), it may not be segmented at that time. Rather, it may be fed directly, as a continuous sheet, into a blister packaging system (120). In the blister packaging system (120), the printed sheet (103*a*) will be used to form blister packaging.

U.S. Pat. No. 6,164,200 to Mathea for "Apparatus for Imprinting an Unmarked Endless Foil" (which is incorporated herein by reference) teaches a system for controlling the timing of printing on a continuous sheet and the feeding of that sheet to a subsequent process. This system can be used in an embodiment of the present invention to meter the output of the sheet (103*a*) to the cutter (108) and handling device (109).

Figure 3:
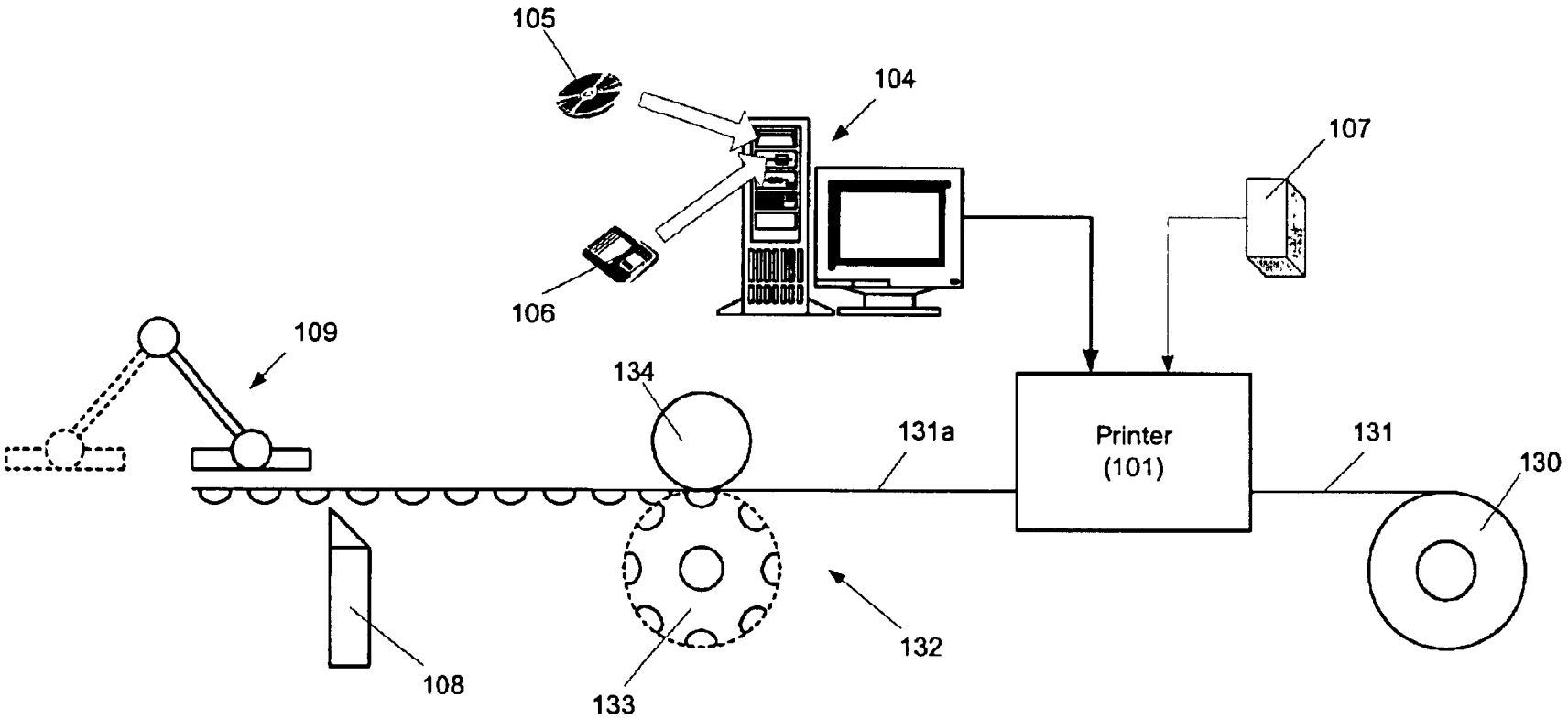
FIG. 3 illustrates another embodiment of the present invention in which a printer is placed in a production line to print a variety of material on a sheet of PVC for blister packaging. The printer, under control of a host system, selectively prints material that is specific and relevant to items then being packaged. The printed sheet is then cut in sections for further processing.

FIG. 3 illustrates another embodiment of the present invention in which a printer is placed in a production line to print a variety of material on a sheet of PVC for blister packaging. The printer, under control of a host system, selectively prints material that is specific and relevant to items then being packaged. The printed sheet is then cut in sections for further processing.

In addition to printing relevant material on the paper, foil or paper-backed foil of a blister package, under principles of the present invention, custom printing can also be performed on the PVC portion of the blister packaging. As shown in FIG. 3, a roll (130) of PVC or similar material is provided for custom printing. The PVC (130) can be clear or colored.

The sheet (131) from the roll (130) is fed through a printer (101). The printer (101) is preferably a color printer so as to provide color printing on the sheet (131). As before, the printer (101) may be, for example, a color laser printer or a color inkjet printer. Inkjet printers typically provide a less expensive color printing solution and, therefore, may be preferred. However, any color printing device could be employed under the principles of the present invention.

As described above, the printer (101) may include a toner or ink cartridge (107) containing ink or toner of three colors that can be mixed to obtain any other color. When the cartridge is empty, or if one of the colors is completely expended, the cartridge (107) can be replaced or refilled.

By placing a printer (101) in the production line, it becomes possible to print any desired pattern, image, text, etc. on the PVC sheet (131). It is simply a matter of feeding a new print job, i.e., new image data, to the printer (101) so that the printer (101) can print material on the sheet (131) that is appropriate to the item for which the packaging is being prepared in any desired length.

As described above, one preferred method of controlling the printer (101) to print material for a variety of different packaging is to connect the printer (101) to a host system (104). For example, when packaging is to be prepared for a particular item, there will be a desired design (e.g., text, images, patterns, etc.) appropriate for that item that can be printed on the PVC sheet (131).

This desired design is provided to host system (104). The desired design can be created on the host system (104) or downloaded to the host system (104) from another device or network to which the host system (104) is connected. Alternatively, the desired design can be created elsewhere and conveyed to the host system (104) on a removable data storage device, such as a floppy disk (106) or a CD-ROM (105).

Once the desired design, in electronic form, is provided to the host system (104), it can be transmitted to the printer (101). The printer (101) will then format the design data and print the desired design on the sheet (131).

When packaging is to be prepared for a different item, requiring a different design to be printed on the sheet (131), there is no need to waste time replacing the roll (130). Rather, a different and appropriate design is transmitted from the host system (104) to the printer (101). The printer (101) then begins producing a printed sheet (131*a*) that has been printed within the new desired design.

After the sheet (131*a*) has been printed, the dimples or recesses must be formed in which packaged items, such as pills, are deposited. This may be done, for example, by running the PVC sheet (131*a*) through a shaping device (132). This shaping device (132) will form the dimples or recesses in the PVC sheet (131*a*) that later receive items to be packaged.

As shown in FIG. 3, the shaping device (132) may include a shaping roller (133). The surface of the shaping roller (133) is dimpled in the same pattern desired for the recessed to be formed in the PVC sheet (131*a*). A heated roller (134) heats and pressed the PVC sheet (131*a*) into the shaping roller (133), causing the sheet (131*a*) to deform into the shaping roller (133) and form the depressions that will be used to receive items being packaged.

After the PVC sheet (131*a*) has been printed and shaped, it can be used in several ways. For example, as shown in FIG. 3, a cutter (108) may segment the sheet (131*a*) for use in individual blister packages. A handling device (109) may be employed to remove individual segments of the printed sheet (131*a*). The sheet segments maybe then sent directly on for use in blister packaging or may be stored for later use or shipment.

Figure 4:
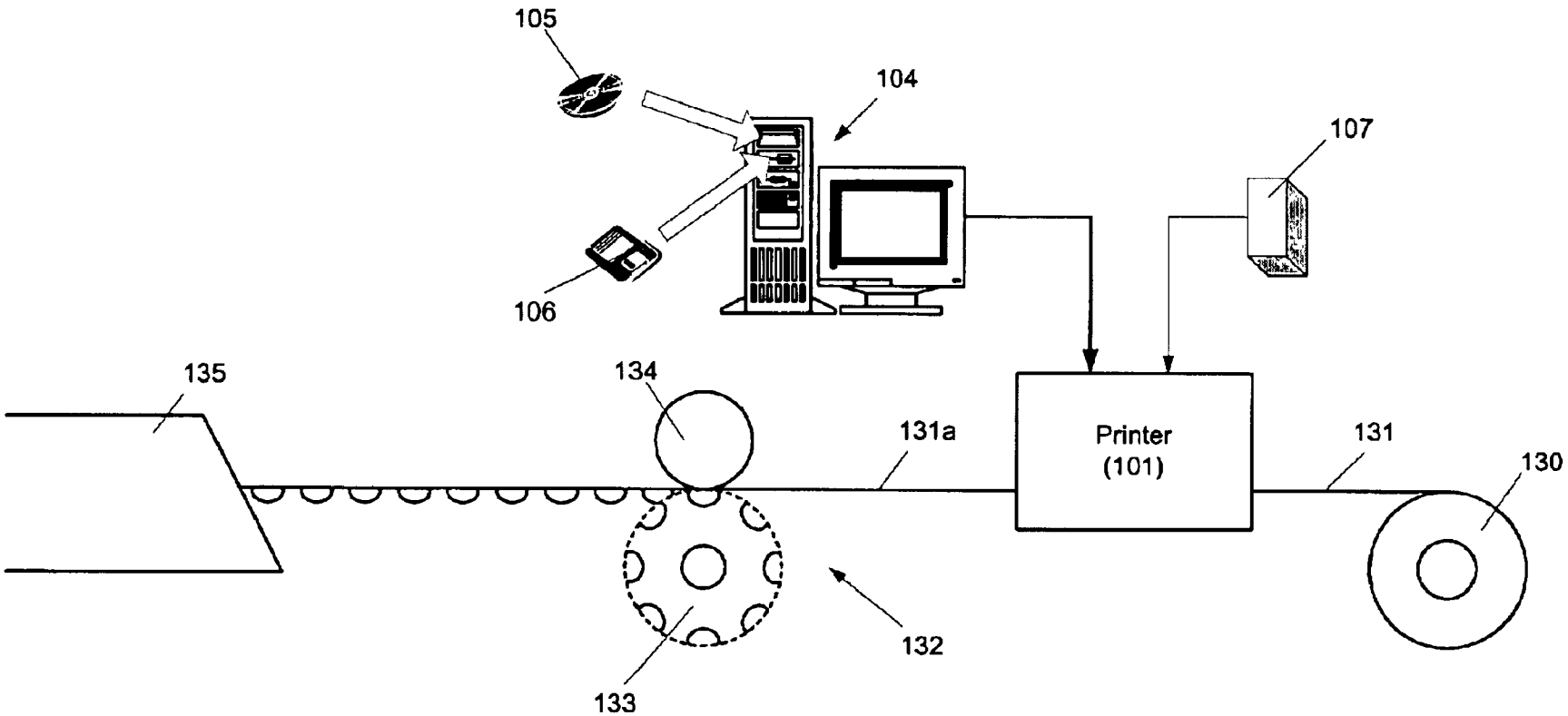
FIG. 4 illustrates another embodiment of the present invention in which a printer is placed in a production line to print a variety of material on a sheet of PVC for blister packaging. The printer, under control of a host system, selectively prints material that is specific and relevant to items then being packaged. The printed sheet is feed as a continuous sheet into a blister packaging production line.

FIG. 4 illustrates another embodiment of the present invention in which a printer is placed in a production line to print a variety of material on a sheet of PVC for blister packaging. The printer, under control of a host system, selectively prints material that is specific and relevant to items then being packaged. The printed sheet is fed as a continuous sheet into a blister packaging production line.

As shown in FIG. 4, after the printed sheet (131*a*) is output by the printer (101) and shaped by the shaping device (132), it may not be segmented at that time. Rather, it may be fed directly, as a continuous sheet, into a blister packaging system (135). In the blister packaging system (135), the printed sheet (131*a*) will be used to form blister packaging.

As will be appreciated by those skilled in the art, either of the systems illustrated in FIGS. 1 and 2 could be combined with one of the systems illustrated in FIGS. 3 and 4 to create a system in which custom printing is provide on both the shaped PVC portion of a blister package and the foil, paper or paper-backed foil used to seal items into the concavities of the shaped PVC portion.

The preceding description has been presented only to illustrate and describe the invention. It is not intended to be exhaustive or to limit the invention to any precise form disclosed. Many modifications and variations are possible in light of the above teaching. The preferred embodiments were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A blister packaging production line comprising:

an unmarked supply of backing for blister packaging;

a printer for selectively printing on said backing; and a host system controlling said printer and providing a variety of desired designs to said printer;

wherein a design being printed on said backing can be changed by transmitting a new design from said host system to said printer.

2. The production line of claim 1, wherein said host system and said printer are integrated.

3. The production line of claim 1, wherein said host system comprises a computer connected to said printer.

4. The production line of claim 1, wherein said printer comprises a color printer.

5. The production line of claim 4, wherein said printer comprises a color inkjet printer.

6. The production line of claim 5, wherein said color inkjet printer contains a cartridge of ink or toner of at least three different colors that can be combined to provide a spectrum of colors in said design printed on said backing.

7. The production line of claim 1, wherein said backing comprises paper-backed foil.

8. The production line of claim 1, wherein said backing comprises foil.

9. The production line of claim 1, wherein said backing comprises paper.

10. The production line of claim 1, wherein said host system comprises a drive for reading a removable data storage medium on which data for a design to be printed on said backing is recorded.

11. The production line of claim 1, further comprising:

a cutter for segmenting said backing after said backing has been printed on by said printer;

a handling device for handling segments of said backing output by said cutter.

12. The production line of claim 1, wherein said backing is fed as a continuous sheet after printing to a blister packaging system.

13. A blister packaging production line comprising:

an unmarked supply of material for blister packaging;

a printer for selectively printing on said material; and a shaping device for forming recesses in said material that will receive items being blister packaged.

14. The production line of claim 13, further comprising:

a host system controlling said printer and providing a variety of desired designs to said printer, wherein a design being printed on said material can be changed by transmitting a new design from said host system to said printer.

15. The production line of claim 14, wherein said host system and said printer are integrated.

16. The production line of claim 14, wherein said host system comprises a computer connected to said printer.

17. The production line of claim 13, wherein said printer comprises a color printer.

18. The production line of claim 17, wherein said printer comprises a color inkjet printer.

19. The production line of claim 18, wherein said color inkjet printer contains a cartridge of ink or toner of at least three different colors that can be combined to provide a spectrum of colors in said design printed on said backing.

20. The production line of claim 13, wherein said material comprises polyvinyl chloride (PVC).

21. The production line of claim 14, wherein said host system comprises a drive for reading a removable data storage medium on which data for a design to be printed on said backing is recorded.

22. The production line of claim 13, further comprising:

a cutter for segmenting said material after said material has been printed on by said printer;

a handling device for handling segments of said material output by said cutter.

23. The production line of claim 13, wherein said material is fed as a continuous sheet to a blister packaging system after printing and shaping.

24. A blister packaging production line comprising:

an unmarked supply of backing for blister packaging;

a printer for selectively printing on said backing;

an unmarked supply of material for blister packaging;

a printer for selectively printing on said material;

a shaping device for forming recesses in said material that will receive items being blister packaged; and a blister packaging system for depositing items to be packaged in said recesses of said material and sealing said backing to said material.

25. The production line of claim 24, further comprising a host system controlling said printers and providing a variety of desired designs to said printers;

wherein a design being printed on said backing or said material can be changed by transmitting a new design from said host system to one of said printers.

26. The production line of claim 24, wherein said printers comprises a color inkjet printer.

27. The production line of claim 24, wherein said backing comprises paper-backed foil, foil or paper.

28. The production line of claim 25, wherein said host system comprises a drive for reading a removable data storage medium on which data for a design to be printed on said backing or said material is recorded.

29. The production line of claim 24, wherein said material comprises polyvinyl chloride (PVC).

30. A method of producing blister packaging comprising:

providing an unmarked supply of backing for blister packaging;

selectively printing on said backing with a printer;

controlling said printer to print a variety of desired designs on said backing; and changing a design being printed on said backing by transmitting a new design to said printer from a host system.

31. The method of claim 30, wherein said printing further comprises printing in color.

32. The method of claim 30, wherein said transmitting a new design further comprises supplying said new design to said host system through a drive for reading a removable data storage medium on which data for said new design is recorded.

33. The method of claim 30, further comprising segmenting said backing after said backing has been printed on by said printer.

34. The method of claim 30, further comprising, after printing, feeding said backing as a continuous sheet to a blister packaging system.

35. A method of producing blister packaging comprising:

providing an unmarked supply of material for blister packaging;

selectively printing on said material; and forming recesses in said material that will receive items being blister packaged.

36. The method of claim 35, further wherein said printing further comprises printing a variety of desired designs on said material with a printer controlled by a host system, wherein a design being printed on said material can be changed by transmitting a new design from said host system to said printer.

37. The method of claim 35, wherein said printing further comprises printing in color.

38. The method of claim 35, wherein said providing material comprises providing polyvinyl chloride (PVC).

39. The method of claim 35, further comprising segmenting said material after said material has been printed.

40. The method of claim 35, further comprising feeding said material as a continuous sheet to a blister packaging system after said printing and shaping.

41. A method of producing blister packaged items comprising:

providing an unmarked supply of backing for blister packaging;

selectively printing on said backing;

providing an unmarked supply of material for blister packaging;

selectively printing on said material;

forming recesses in said material that will receive items being blister packaged;

depositing items to be packaged in said recesses of said material; and sealing said backing to said material to produce said blister packaged items.

42. A system for producing blister packaging comprising:

means for providing an unmarked supply of backing for blister packaging;

means for selectively printing on said backing;

means for controlling said printing means to print a variety of desired designs on said backing; and means for changing a design being printed on said backing by said printing means.

43. A system for producing blister packaging comprising:

means for providing an unmarked supply of material for blister packaging;

means for selectively printing on said material; and means for forming recesses in said material that will receive items being blister packaged.

44. A system for producing blister packaged items comprising:

means for providing an unmarked supply of backing for blister packaging;

means for selectively printing on said backing;

means for providing an unmarked supply of material for blister packaging;

means for selectively printing on said material;

means for forming recesses in said material that will receive items being blister packaged;

means for depositing items to be packaged in said recesses of said material; and means for sealing said backing to said material to produce said blister packaged items.

45. A blister packaging production line comprising:

an unmarked supply of backing for blister packaging that has not been applied to a blister package;

a printer for selectively printing on said backing; and a host system controlling said printer and providing a variety of desired designs to said printer;

wherein a design being printed on said backing can be changed by transmitting a new design from said host system to said printer.

46. The production line of claim 45, further comprising a packaging system for receiving said backing after printing and applying said backing to seal blister packages.

47. The production line of claim 46, further comprising a cutter to segment said backing before said backing is applied to seal blister packages.

* * * * *